US011219340B2

(12) United States Patent
Regalado Cano

(10) Patent No.: US 11,219,340 B2
(45) Date of Patent: Jan. 11, 2022

(54) SLIDING TOILET PAPER HOLDER

(71) Applicant: Jose Luis Regalado Cano, Apache Junction, AZ (US)

(72) Inventor: Jose Luis Regalado Cano, Apache Junction, AZ (US)

( * ) Notice: Subject to any disclaimer, the term of this patent is extended or adjusted under 35 U.S.C. 154(b) by 28 days.

(21) Appl. No.: 16/825,741

(22) Filed: Mar. 20, 2020

(65) Prior Publication Data

US 2020/0297170 A1 Sep. 24, 2020

Related U.S. Application Data

(60) Provisional application No. 62/820,974, filed on Mar. 20, 2019.

(51) Int. Cl.
*A47K 10/40* (2006.01)
*A47K 10/36* (2006.01)
*A47K 10/38* (2006.01)

(52) U.S. Cl.
CPC ..... *A47K 10/40* (2013.01); *A47K 10/3687* (2013.01); *A47K 10/3836* (2013.01)

(58) Field of Classification Search
CPC ..... A47K 10/40; A47K 10/3687; A47K 10/3836; A47K 2010/3253; A47K 10/22; A47K 2010/3233; A47K 2201/02; A47K 10/38
USPC ..... 242/591, 592
See application file for complete search history.

(56) References Cited

U.S. PATENT DOCUMENTS

| | | | | | |
|---|---|---|---|---|---|
| 5,868,345 | A * | 2/1999 | Beisser | A47K 10/38 | 242/592 |
| 5,871,170 | A * | 2/1999 | Morales | A47K 10/40 | 242/592 |
| 5,967,452 | A * | 10/1999 | Wilder | A47K 10/3836 | 242/592 |
| 6,527,219 | B1 * | 3/2003 | Trecartin | A47K 10/38 | 242/592 |
| 6,988,691 | B1 * | 1/2006 | Lai | A47K 10/38 | 242/594 |
| D782,843 | S * | 4/2017 | Thompson | D6/523 | |
| 10,219,658 | B2 * | 3/2019 | Simmons | A47K 10/22 | |
| 10,743,725 | B2 * | 8/2020 | Scheimberg | A47K 10/22 | |
| 2016/0095478 | A1 * | 4/2016 | Toma | A47K 10/42 | 242/594 |

* cited by examiner

*Primary Examiner* — William A. Rivera
(74) *Attorney, Agent, or Firm* — Dunlap Bennett & Ludwig, PLLC; Brendan E. Squire

(57) ABSTRACT

A method and apparatus for dispensing toilet paper is disclosed. A sliding toilet paper holder includes a toilet paper holder configured to carry and dispense a roll of toilet paper. A slide assembly is coupled to the toilet paper holder and is attachable to a support structure adjacent to a toilet. The slide assembly operable between a stowed position and an extended position to selectively extend and retract the toilet paper holder. The apparatus and method permits a user to more readily access and dispense a desired quantity of toilet paper while seated on a toilet and to stow the toilet paper carried on the toilet paper holder when not needed. A spare tissue spindle may also be carried by the slide assembly.

13 Claims, 2 Drawing Sheets

SLIDING TOILET PAPER HOLDER

CROSS-REFERENCE TO RELATED APPLICATION

This application claims the benefit of priority of U.S. provisional application No. 62/820,974, filed Mar. 20, 2019, the contents of which are herein incorporated by reference.

BACKGROUND OF THE INVENTION

The present invention relates to bathroom fixtures and, more particularly, to holders for toilet paper.

In many structures, the bathroom enclosures are provided with a limited space. In these circumstances a toilet tissue holder is typically mounted immediately adjacent to and in some instances, behind the user while they are seated on the toilet. When the tissue holder is too close to the user, it can be difficult to dispense the toilet paper. Likewise, when positioned behind the user, the user must twist their body in order to dispense the toilet paper.

In extreme circumstances, it may also be uncomfortable to even sit upon the toilet, where the toilet paper holder protrudes into or otherwise encroaches upon the area immediately adjacent to the toilet.

As can be seen, there is a need for an improved apparatus and method for dispensing toilet paper.

SUMMARY OF THE INVENTION

In one aspect of the present invention, a sliding toilet paper holder, is disclosed. The sliding toilet paper holder includes a toilet paper holder that is configured to carry and dispense a roll of toilet paper. A slide assembly coupled to the toilet paper holder and attachable to a support structure adjacent to a toilet. The slide is assembly is operable between a stowed position and an extended position to selectively extend and retract the toilet paper holder.

In some embodiments, the slide assembly includes an inner rail member that is attachable to the support structure. An outer rail member is attachable to the toilet paper holder, wherein the inner rail member and the outer rail member are extensible and retractable relative each other. A bearing may be interposed between the inner rail member and the outer rail member.

In some embodiments, a base plate interposed between the toilet paper holder and the outer rail member.

In other embodiments, a spare tissue spindle carried by the slide assembly. A swivel mount may be provided to pivotally couple the spare tissue spindle to the slide assembly.

In yet other embodiments, a toilet tissue roll is carried by the toilet paper holder.

In other aspects of the invention, a method of dispensing toilet tissue is disclosed. The method includes the steps of attaching a toilet paper holder to a support structure adjacent to a toilet. The toilet paper holder is carried on a slide assembly that is selectively operable between a stowed position, adjacent to the toilet and an extended position towards a front of the toilet.

The method may include extending the toilet paper holder to the extended position.

In other method steps, a toilet paper roll may be suspended on the toilet paper holder. A desired quantity of toilet paper may then be dispensed from the toilet paper roll.

The method may also include the step of retracting the toilet paper holder to the stowed position.

In other embodiments, the method may include attaching a spare tissue spindle for carriage by the slide assembly. In this embodiment, the method may also include suspending a spare toilet paper roll on the spare tissue spindle.

These and other features, aspects and advantages of the present invention will become better understood with reference to the following drawings, description and claims.

DETAILED DESCRIPTION OF THE INVENTION

Figure 1:
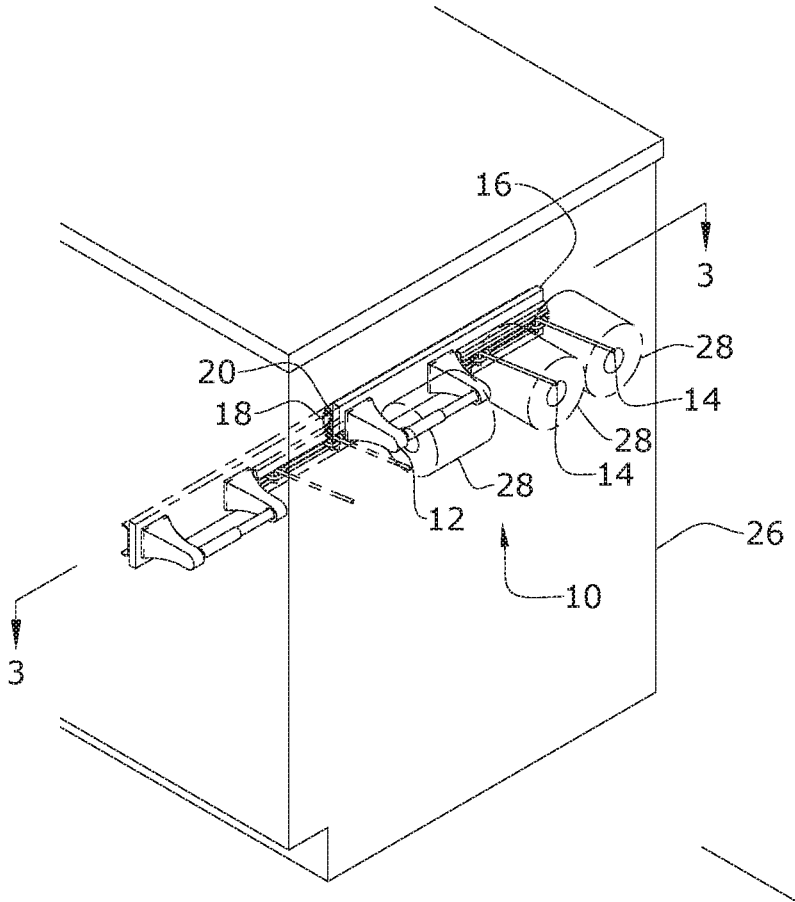
FIG. 1 is an in-use perspective view of an embodiment of a sliding toilet paper holder.
Figure 2:
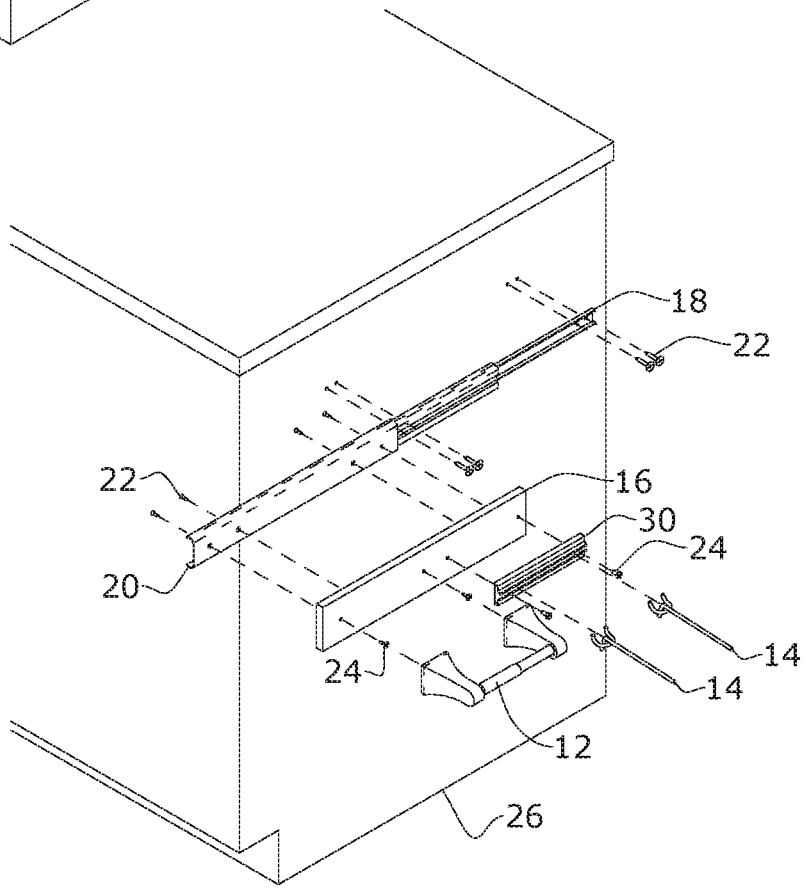
FIG. 2 is an exploded perspective view of the sliding toilet paper holder.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved method and apparatus that permits the user to selectively extend and retract a toilet paper holder between a stowed position and an extended position. The sliding toilet paper holder is particularly useful in bathrooms with confined conditions, permitting the user better access a roll of toilet tissue when needed and stow the toilet tissue when not needed.

A sliding toilet paper holder 10 according to aspects of the invention is shown in reference to the drawings of FIGS. 1-4. The sliding toilet paper holder 10 includes a standard toilet dispenser carrier 12 that is mounted to a slide assembly 15. The slide assembly 15 is attached to a supporting surface 26 adjacent to a toilet (not shown) within a bathroom. The supporting surface may be a vertical wall 26 of the bathroom enclosure or a sidewall of a vanity or other cabinet located within the bathroom adjacent to the toilet.

In the non-limiting embodiment shown, the standard toilet tissue dispenser carrier 12 may include two posts with a spindle that is operatively coupled to the posts. A toilet tissue roll 28 is suspended on the spindle. In these embodiments, a base plate 16 may be necessary to mount the toilet tissue dispenser carrier 12 to the slide assembly. In other embodiments, the toilet dispenser carrier 12 may have a base that may be directly coupled to the slide assembly 15. The base 16 and the toilet tissue dispenser carrier 12 may be attached with a fastener 24 such as a screw, bolt, pin, adhesives or rivets.

In the non-limiting embodiment shown, the slide assembly 15, may be a cabinet drawer slide, having an inner slide member 18 and an outer slide member 20, that may be carried relative to each other on a plurality of ball bearings or other low friction slide operating mechanism. The inner slide member 18 is attached to a support structure 26 via a plurality of fasteners 22, such as pins, bolts, screws, adhesives, or rivets. The outer slide member 20 is attached to one of the base 16 or a base of the toilet tissue holder 12 by a plurality of fasteners 22, such as pins, bolts, screws, adhesives, or rivets.

Figure 3:
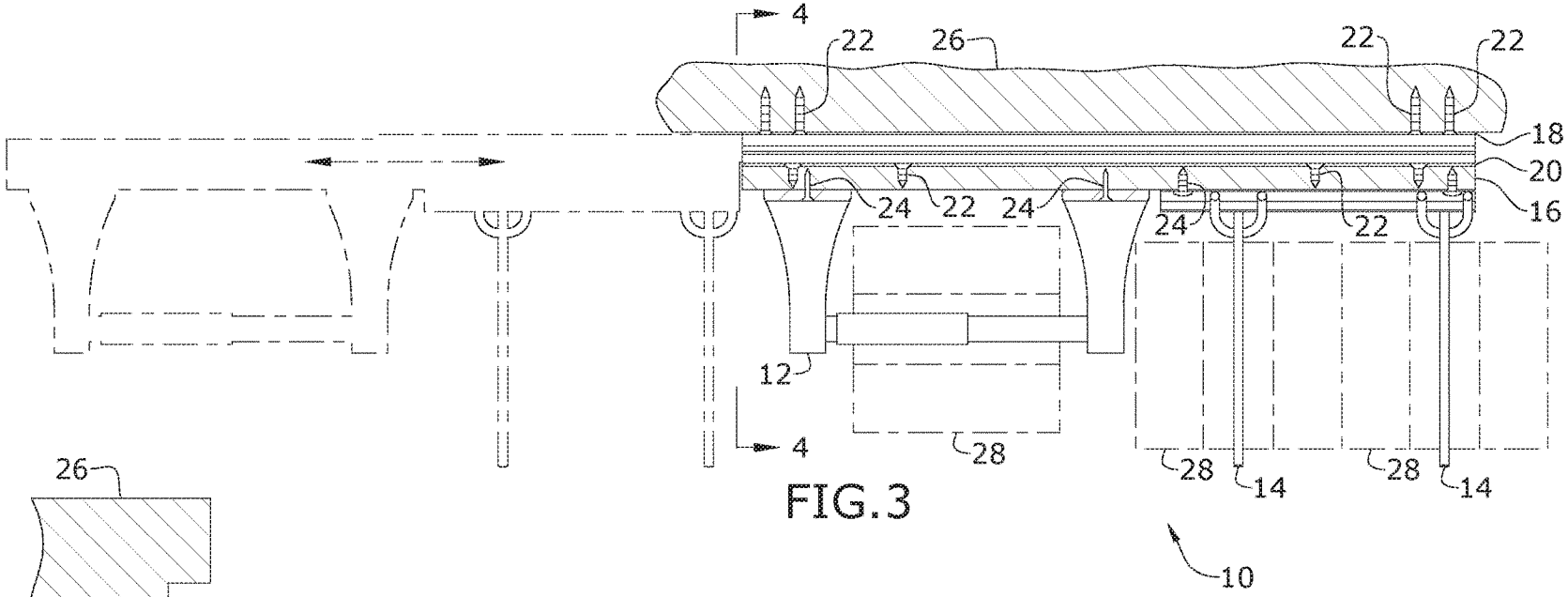
FIG. 3 is a section view of the sliding toilet paper holder taken along line 3-3 in FIG. 1.
Figure 4:
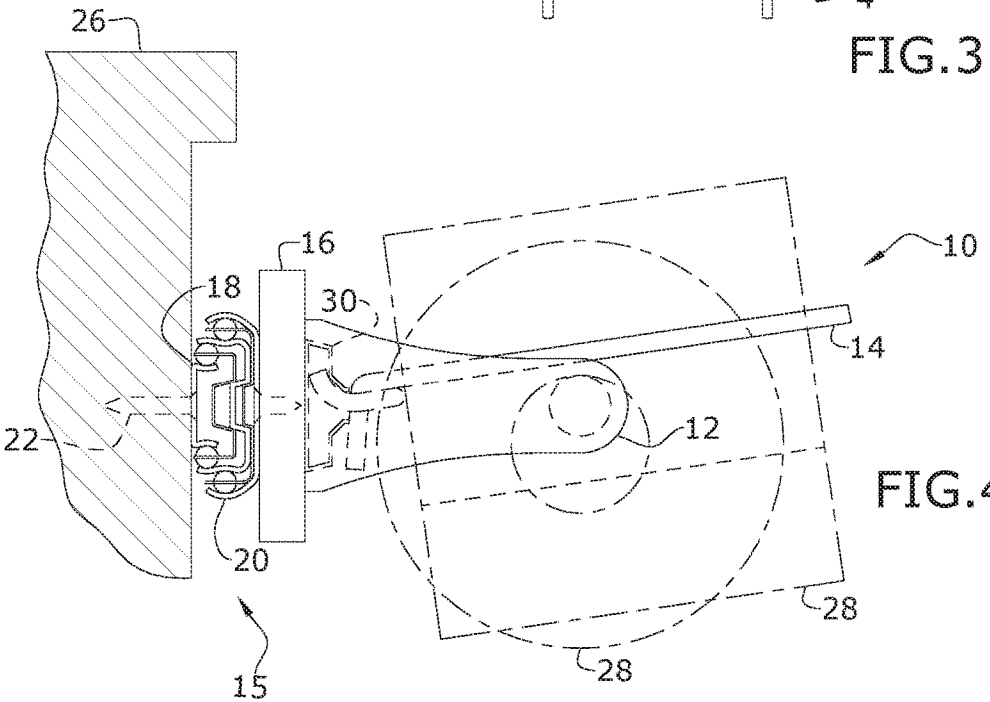
FIG. 4 is a section view of the sliding toilet paper holder taken along line 4-4 in FIG. 3.

As seen in reference to FIG. 3, the slide assembly 15 is operable between a stowed position an extended position. In the stowed position, the toilet tissue dispenser 12 is retracted and in many bathrooms may be very closely positioned adjacent to the user while seated on the toilet, making it difficult to dispense toilet tissue from the toilet tissue roll 28. In the extended position, the toilet tissue dispenser 12 is positioned towards, and preferably beyond a forward end of the toilet so that the toilet tissue is easily dispensed from the toilet tissue roll 28.

In the non-limiting embodiment shown, the slide assembly 15 is mounted to a support structure adjacent to the toilet. Typically the support structure 26 is a wall, vanity, or other cabinetry in the bathroom adjacent to the toilet. The slide assembly 15 is preferably mounted in a horizontal orientation, but may be mounted with a slightly aft tilt to permit the slide assembly to return to the stowed position by gravity, with a slight push of the toilet tissue dispenser 12, when no longer needed. The slide assembly 15 may also include an indexed stop to retain the toilet tissue dispenser 12 in the extended position.

In some embodiments, one or more spare tissue spindle 14 may also be mounted to the slide assembly 15. The spare tissue spindle 14 includes a laterally projecting spindle on which to suspend a spare toilet tissue roll 28. In preferred embodiments, the spare tissue spindle 14 may be pivotally carried on a swivel mount 30, permitting the user to position the spare tissue spindle 14 adjacent to the slide assembly 15 when no spare toilet tissue rolls 28 are carried on the spare tissue spindle.

It should be understood, of course, that the foregoing relates to exemplary embodiments of the invention and that modifications may be made without departing from the spirit and scope of the invention as set forth in the following claims.

What is claimed is:

1. A sliding toilet paper holder, comprising:

a toilet paper holder configured to carry and dispense a roll of toilet paper;

a slide assembly coupled to the toilet paper holder and attachable to a vertical support structure adjacent to a toilet, the slide assembly laterally operable between a stowed position and an extended position to selectively extend and retract the toilet paper holder laterally along the vertical support structure; and a spare tissue spindle carried on the slide assembly and operable to be positioned adjacent to the slide assembly when no spare toilet tissue rolls are carried on the spare tissue spindle.

2. The sliding toilet paper holder of claim 1, wherein the slide assembly further comprises:

an inner rail member attachable to the support structure; and an outer rail member attachable to the toilet paper holder, wherein the inner rail member and the outer rail member are extensible and retractable relative each other.

3. The sliding toilet paper holder of claim 2, further comprising:

a bearing interposed between the inner rail member and the outer rail member.

4. The sliding toilet paper holder of claim 2, further comprising:

a base plate interposed between the toilet paper holder and the outer rail member.

5. The sliding toilet paper holder of claim 1, further comprising:

a swivel mount to pivotally couple the spare tissue spindle to the slide assembly.

6. The sliding toilet paper holder of claim 1, further comprising:

a toilet tissue roll carried by the toilet paper holder.

7. A method of dispensing toilet tissue, comprising:

attaching a toilet paper holder to a vertical support structure adjacent to a toilet, the toilet paper holder carried on a slide assembly selectively operable to laterally extend between a stowed position, adjacent to the toilet and an extended position towards a front of the toilet; and attaching a spare tissue spindle to the slide assembly, the spare tissue spindle operable to be positioned adjacent to the slide assembly when no spare toilet tissue rolls are carried on the spare tissue spindle.

8. The method of claim 7, further comprising:

extending the toilet paper holder to the extended position.

9. The method of claim 8, further comprising:

suspending a toilet paper roll on the toilet paper holder.

10. The method of claim 9, further comprising:

dispensing a desired quantity of toilet paper from the toilet paper roll.

11. The method of claim 7, further comprising:

retracting the toilet paper holder to the stowed position.

12. The method of claim 7, further comprising:

positioning the spare tissue spindle away from the slide assembly.

13. The method of claim 12, further comprising:

suspending a spare toilet paper roll on the spare tissue spindle.

* * * * *